US009712935B2

(12) United States Patent
Winter et al.

(10) Patent No.: US 9,712,935 B2
(45) Date of Patent: Jul. 18, 2017

(54) MICROPHONE COMPATIBILITY

(71) Applicant: Bose Corporation, Framingham, MA (US)

(72) Inventors: Kevin J. Winter, Hingham, MA (US); Edwin C. Johnson, Jr., Hopkinton, MA (US)

(73) Assignee: BOSE CORPORATION, Framingham, MA (US)

( * ) Notice: Subject to any disclaimer, the term of this patent is extended or adjusted under 35 U.S.C. 154(b) by 59 days.

(21) Appl. No.: 14/840,761

(22) Filed: Aug. 31, 2015

(65) Prior Publication Data

US 2017/0064477 A1 Mar. 2, 2017

(51) Int. Cl.
*H04R 29/00* (2006.01)
*H04R 3/00* (2006.01)

(52) U.S. Cl.
CPC ..... *H04R 29/004* (2013.01); *H04R 3/00* (2013.01); *H04R 2420/05* (2013.01)

(58) Field of Classification Search
CPC ..... H04R 3/00; H04R 29/004
USPC ..... 381/58, 111, 122
See application file for complete search history.

(56) References Cited

U.S. PATENT DOCUMENTS

| | | | | |
|---|---|---|---|---|
| 8,064,613 | B1 | 11/2011 | Helfrich | |
| 2008/0167092 | A1 | 7/2008 | Ueda et al. | |
| 2010/0166227 | A1* | 7/2010 | Pennock | H04R 19/016 381/111 |
| 2014/0043742 | A1* | 2/2014 | Lamba | G06F 1/266 361/679.4 |

OTHER PUBLICATIONS

International Search Report in counterpart International Patent Application No. PCT/US15/47141, mailed on Jan. 17, 2017; 16 pages.
Invitation to Pay Additional Fees & Partial Search Report in counterpart International Patent Application No. PCT/US15/47141, mailed on Nov. 22, 2016; 6 pages.

* cited by examiner

*Primary Examiner* — Paul S Kim
*Assistant Examiner* — Katherine Faley
(74) *Attorney, Agent, or Firm* — Schmeiser, Olsen & Watts LLP

(57) ABSTRACT

Provided is a microphone compatibility device comprising a sensor that detects a voltage along a conductive path between a microphone and at least one electronic device and a current control device that draws current for permitting microphone detection by each of a first electronic device and a second electronic device. The second electronic device has a lower current draw requirement than the first electronic device.

20 Claims, 6 Drawing Sheets

MICROPHONE COMPATIBILITY

BACKGROUND

This description relates generally to microphones for electronic devices, and more specifically, to systems and methods that provide microphone compatibility between different electronic devices.

BRIEF SUMMARY

In a general aspect, provided is a microphone compatibility device, comprising: a sensor that detects a voltage along a conductive path between a microphone and an electronic device of a first or second type; and a regulator that draws current for satisfying a microphone detection current draw requirement of the first type of electronic device, and that prevents a current draw for the second type of electronic device having a lower microphone detection current draw requirement than the microphone detection current draw requirement of the first type of electronic device.

Aspects may include one or more of the following features:

The regulator may include a voltage controlled current shunt.

The detected voltage may be greater than a predetermined voltage, and the current may be drawn by the regulator when the detected voltage is greater than the predetermined voltage.

The predetermined voltage may be greater than a minimum voltage supply of the electronic device.

The microphone compatibility device may further comprise a current limiter that controls an amount of current through the regulator according to device requirements.

The regulator may draw the current from time of a connection or enabling event to a time of a physical disconnection or disabling event between the microphone and the second electronic device.

In another general aspect, provided is a microphone compatibility device, comprising: a sensor that detects a voltage along a conductive path formed at an initial time between a microphone and an electronic device; a timer that establishes a period of time after the initial time during which additional current is drawn; and a shunt device that shunts a current so that the additional current is drawn during the period of time after the initial time.

Aspects may include one or more of the following features:

The electronic device may require the additional current to be drawn in order to detect the microphone.

The electronic device may not require the additional current to be drawn in order to detect the microphone, and wherein the microphone is activated after the period of time.

The microphone compatibility device may further comprise a reset device that resets the device after a physical disconnection or disabling event affecting a transfer of voltage between the microphone and the electronic device.

The timer may include an RC circuit, and the reset device drains the capacitor after the physical connection or disabling event.

In another general aspect, a microphone compatibility device, comprises a sensor that detects a voltage along a conductive path between a microphone and at least one electronic device; and a current control device that draws current for permitting microphone detection by each of a first electronic device and a second electronic device, the second electronic device having a lower current draw requirement than the first electronic device.

Aspects may include one or more of the following features:

The current control device may include a regulator that draws current for satisfying a microphone detection current draw requirement of a first electronic device, and that prevents a current draw for the second electronic device.

The regulator may include a voltage controlled current shunt.

The detected voltage may be greater than a predetermined voltage, and the current may be drawn by the regulator when the detected voltage is greater than the predetermined voltage.

The microphone compatibility device may further comprise a current limiter that controls an amount of current through the regulator according to device requirements.

The regulator may draw the current from time of a connection or enabling event to a time of a physical disconnection or disabling event between the microphone and the second electronic device.

The current control device may include a timer that establishes a period of time after the initial time during which additional current is drawn and a shunt device that shunts a current so that the additional current is drawn during the period of time after the initial time.

The second electronic device may not require the additional current to be drawn in order to detect the microphone, and the microphone may be activated after the period of time.

The microphone compatibility device may further comprise a reset device that resets the device after a physical disconnection or disabling event affecting a transfer of voltage between the microphone and the first or second electronic device.

BRIEF DESCRIPTION OF DRAWINGS

The above and further advantages may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Microphones are readily used by smartphones or other mobile electronic devices for providing voice commands. However, some devices provide a microphone detection scheme that requires a significant current draw in order detect a microphone, while other devices require support for low bias voltage microphones that do not draw a significant amount of current, and require low current consumption to operate properly at all possible microphone bias voltages. Incompatibility issues may arise due to the inability of the same microphone to be detected by some devices requiring a high current draw such as Apple iOS devices, while maintaining low power operation required by other devices requiring low bias voltage microphones that draw low current, such as Samsung devices executing an Android operating system.

Figure 1:
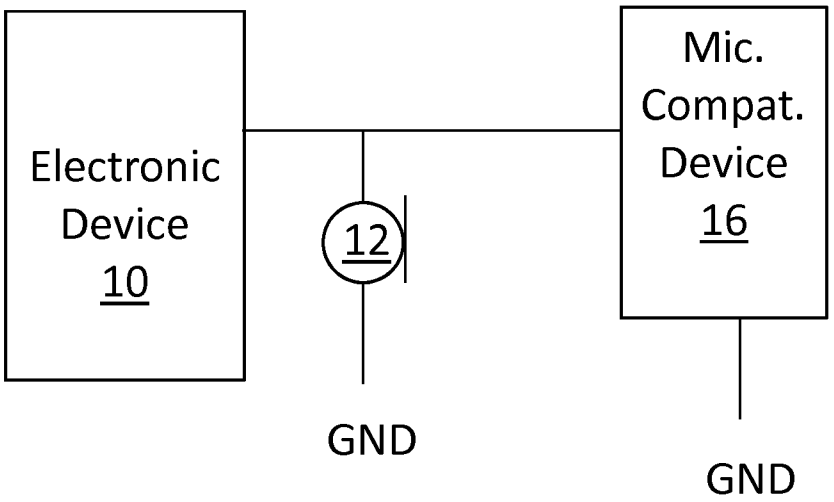
FIG. 1 is a block diagram of a microphone compatibility system, in accordance with some examples.

FIG. 1 is a block diagram of a microphone compatibility system, in accordance with some examples.

A microphone compatibility device 16 is connected to a circuit between a microphone 12 and an electronic device 10. Where their grounds are common, the compatibility device 16 is in parallel to the microphone 12. The electronic device 10 requires a predetermined current consumption for the microphone 12 to operate with the device 10. During operation, the microphone 12 receives sound waves and modulates the amount of current electricity flowing through the microphone, and therefore the voltage on the microphone input, which is detected by the microphone compatibility device 16. The microphone 12 may be a microelectromechanical systems (MEMS) microphone or the like. However, other microphone types can equally apply. The electronic device 10 can be a portable computer such as a smartphone, laptop computer, notepad computer, and so on. The electronic device 10 includes an input port, such as an audio or microphone input for receiving an electric current from the microphone 12. The input port is commonly a single terminal of a combined input/output jack, with a ground terminal shared between input and output.

The microphone compatibility device 16 adjusts or compensates for the current consumption requirements of different electronic devices. For example, the microphone compatibility device 16 may allow a microphone 12 to support a range of bias voltages required by one device specification, for example, devices running a mobile operating system such as Android™, and also be compatible with other devices with high current consumption requirements. Here, the microphone 12 may be permitted to pass detection tests of different devices, regardless of power requirements. In some embodiments, the microphone compatibility device 16 can be constructed and arranged to consume additional power when detected by an iOS device. In some embodiments, the microphone compatibility device 16 consumes extra power at higher voltages only when the microphone 12 can accommodate for the higher voltages. In other embodiments, the microphone compatibility device 16 consumes extra power only briefly during detection after connection to an electronic device, after which the device 16 returns to a low power operation.

Figure 2:
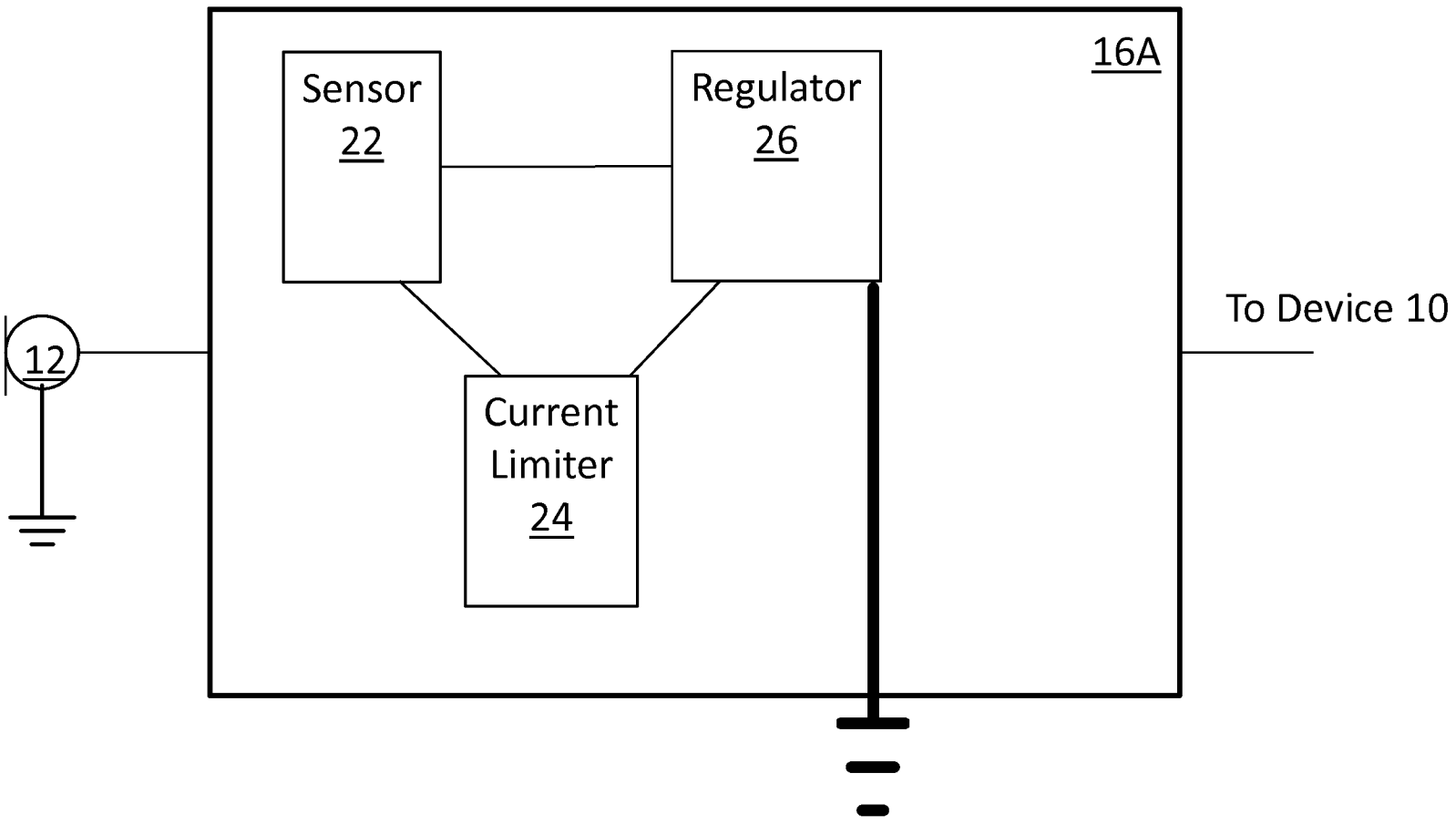
FIG. 2 is a block diagram of a microphone compatibility device, in accordance with some embodiments.

FIG. 2 is a block diagram of a microphone compatibility device 16A, in accordance with some embodiments. The microphone compatibility device 16A can function as a voltage-dependent current shunt, whereby current is drawn from an electronic device requiring high current consumption for detecting the microphone 12, and maintaining a bias voltage for electronic devices requiring lower voltages and that wouldn't draw enough current otherwise required by the high current draw devices.

The microphone compatibility device 16A is constructed and arranged to draw additional current when connected to a device having a detection scheme requiring a significant amount of current for detecting a microphone, for example, 210 μA-500 μA required by an iOS device for microphone detection.

To achieve this, the microphone compatibility device 16A comprises a sensor 22, a current limiter 24, and a voltage regulator 26. The sensor 22, current limiter 24, and/or regulator 26 can be under the housing of a single device as shown in FIG. 2, or separated into different devices. The microphone compatibility device 16A may also include a connector to the microphone 12, a connector to the electronic device 10, or a connector to both the microphone 12 and the electronic device 10. In some cases, the components of the device 16 are on a common PCB with the microphone 12 and connected to it through conductors on the PCB.

The voltage sensor 22 is positioned between the microphone 12 and a microphone input at an electronic device 10 so that the sensor 22 can establish whether an electrical connection is made between the microphone 12 and the electronic device 10. In particular, the voltage sensor 22 monitors a voltage on the line between the microphone 12 and the electronic device 10 and is enabled by the presence of a voltage.

The current limiter 24 limits current through the voltage regulator 26. For example, the current limiter may include a resistor that controls current draw according to device requirements.

The voltage regulator 26 provides a stable voltage and serves as a shunt regulator for drawing extra current in particular from a device 10 for detection, for example, iOS devices, when a determination is made that the sensor 22 detects a connection between the microphone 12 and an electronic device 10. As previously described, some devices may require support for very low bias voltage microphones that don't draw a high amount of current, while other devices require a high current draw in order to detect a microphone. The voltage regulator 26 can provide a current sink so that the microphone compatibility device 16A can accommodate either device type.

Figures 3A, 3B:
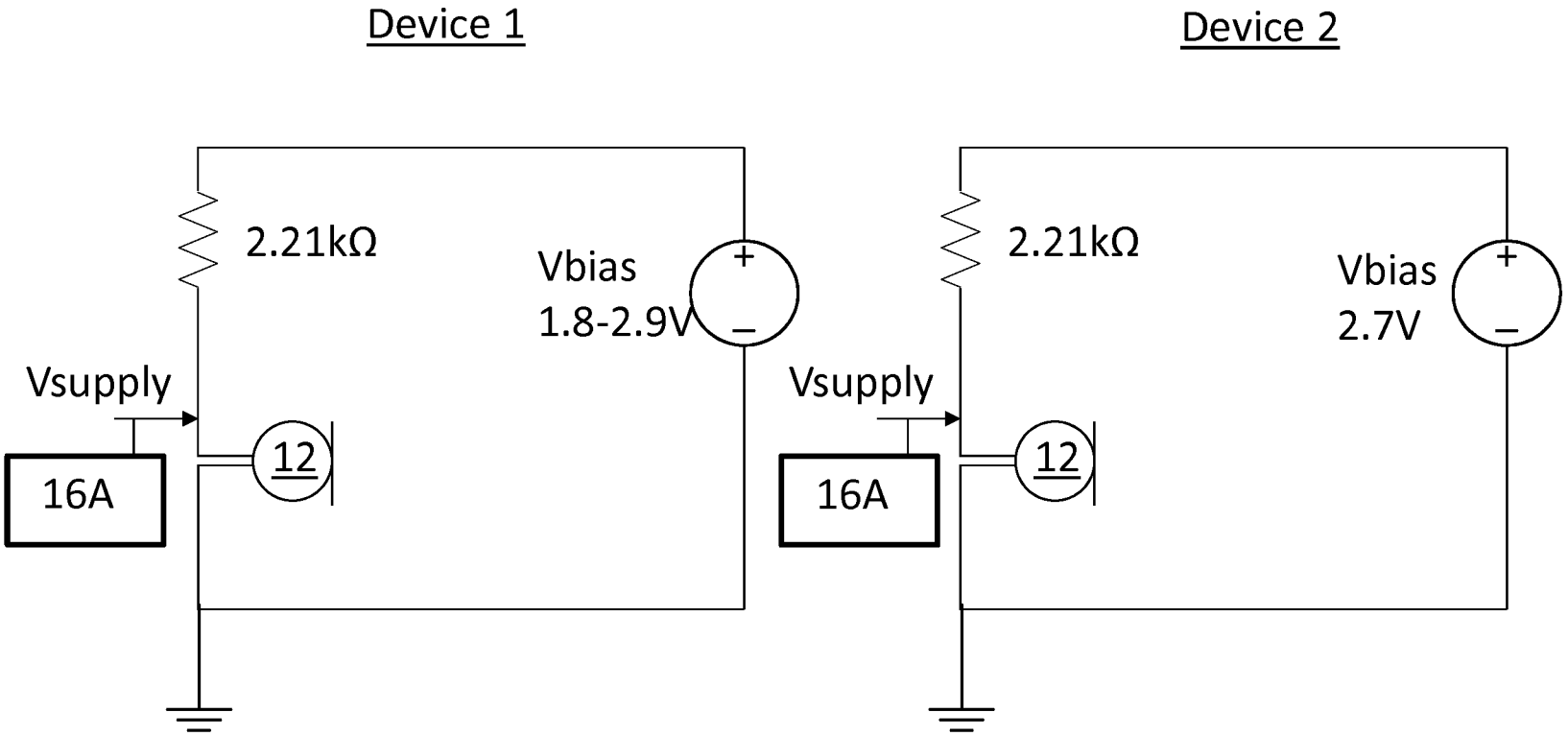
FIGS. 3A and 3B are electrical circuit diagrams, each illustrating a simplified model of a microphone and an electronic device, in accordance with some embodiments.

For example, referring to FIGS. 3A and 3B, two electronic devices (Device 1, Device 2) may each have different specification electrical parameters shown in Table 1. In some embodiments, Device 1 may execute an Android™ operating system, and Device 2 may execute an iOS operating system.

TABLE 1

| | Device 1 | Device 2 |
|---|---|---|
| Mic Bias Voltage | 1.8 V-2.9 V | 2.7 V |
| Mic Bias Resister | 2.21 kΩ | 2.21 kΩ |
| MEMS Vsupply (Minimum) | 1.5 V | 1.5 V |
| Microphone Current | <136 μA | 210 μA-500 μA |

As shown in Table 1 and FIG. 3A, Device 1 requires a microphone current of no more than 136 μA in order to maintain a minimum voltage supply (Vsupply), for example, 1.5V. On the other hand, Device 2 requires a high amount of current (210 μA-500 μA) required by Device 2 for microphone detection.

At FIG. 3A, when a lower voltage is detected, for example, 1.8V, and the microphone compatibility device 16A does not draw additional current so that microphone 12 may operate with Device 1. Here, the microphone current required to maintain the Vsupply voltage at 1.5V bias is less than 136 μA. As described above, Device 1 requires support for low bias voltage microphones.

At FIG. 3B, Device 2 requires a microphone current that is significantly greater than that of Device 1, for example, 210 μA-500 μA, for microphone detection. The microphone compatibility device 16A is activated here to provide sufficient current to Device 2 requiring high current consumption for detecting the microphone 12.

Referring to Table 1 illustrated by way of example above, a microphone may have a minimum Vsupply limit of 1.5V, and will turn off if its voltage drops below this minimum voltage. Depending on the electronic device's output voltage, e.g., 1.8-2.9V, the output voltage may be close to the minimum voltage. As previously described, additional current must be drawn to be detected by Device 2. However, this can only be achieved if the Vsupply is higher than the minimum voltage (e.g., 1.5V). In embodiments where an electronic device operates at a sufficient voltage, for example, 2.7V, the microphone compatibility device 16A can draw extra current when a voltage above a predetermined voltage, e.g., 2.0V, is detected.

Figure 4:
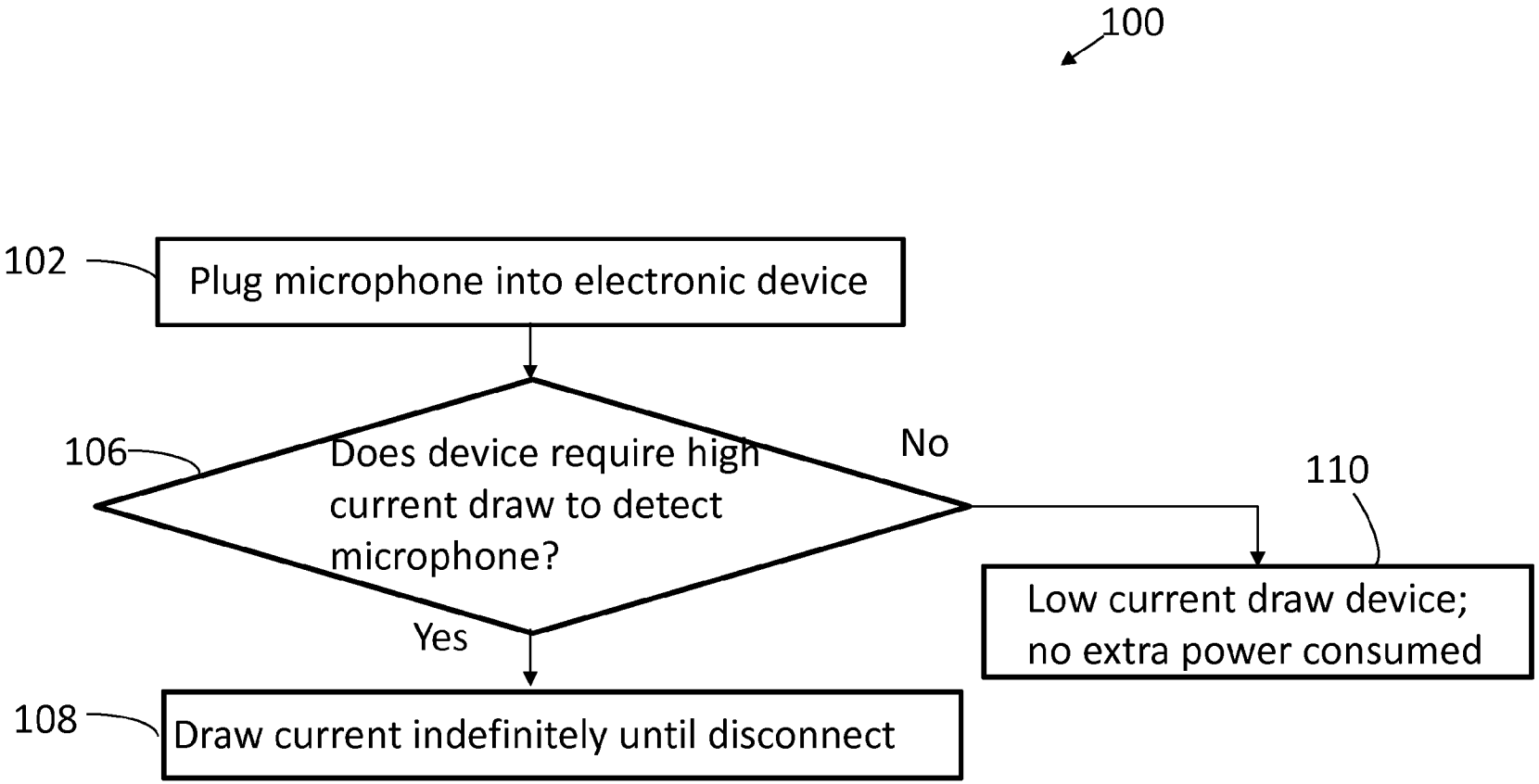
FIG. 4 is a flow diagram of a method for a controlled current draw for microphone compatibility, in accordance with some embodiments.

FIG. 4 is a flow diagram of a method 100 for a controlled current draw for microphone compatibility, in accordance with some embodiments. In describing the method 100, reference is made to elements of FIGS. 1-3.

At block 102, the microphone 12 is directly or indirectly coupled to an electronic device 10. The electronic device 10 may include a microphone detection scheme that requires significant current consumption to detect the microphone 12, or require low current consumption to operate properly at all possible microphone bias voltages. When the microphone 12 establishes the electronic device 10 in this manner, an electrical path is formed whereby current flows between the microphone 12 and the electronic device 10.

Some electronic devices 10 may execute a microphone detection process. At decision diamond 106, a determination is made whether the device requires a high current draw to detect the microphone 12. If yes, then the method 100 proceeds to block 108 where the current between the microphone 12 and the electronic device 10 is controlled so that the device's microphone detection requirements are satisfied with respect to current draw. Here, current can be drawn indefinitely until disconnection. Otherwise, the method 100 proceeds to block 110, where a low current draw device 10 is connected to the microphone 12. Here, the voltage dependent current shunt doesn't draw current so no additional power is consumed, and the microphone operates with the low current draw device 10.

Figure 5:
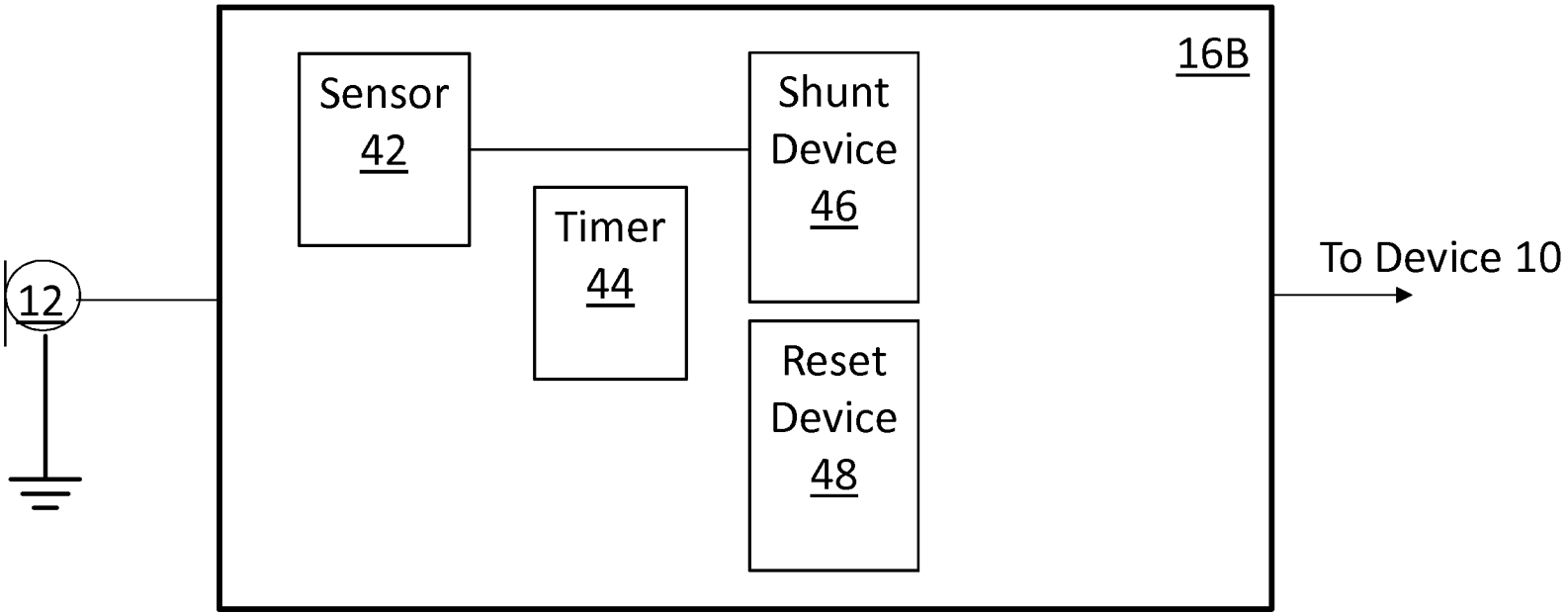
FIG. 5 is a block diagram of a microphone compatibility device, in accordance with some embodiments.

FIG. 5 is a block diagram of a microphone compatibility device 16B, in accordance with some embodiments. The microphone compatibility device 16B can function as a timed current shunt, whereby sufficient current is provided to an electronic device requiring high current consumption only briefly during detection of the microphone 12, whereby low power operation subsequently occurs.

The microphone compatibility device 16B comprises a sensor 42, a timer 44, a shut device 46, and a reset device 48. The sensor 42, timer 44, shunt device 46, and reset device 48 can be under the housing of a same device as shown in FIG. 5, or separated into different devices. The microphone compatibility device 16B may also include a connector to the microphone 12, a connector to the electronic device 10, or a connector to both the microphone 12 and the electronic device 16.

The sensor 42 is parallel the microphone 12 and a microphone input at an electronic device 10 so that the sensor 42 can establish whether an electrical connection is made between the microphone 12 and the electronic device 10.

The timer 44 permits extra power to be consumed briefly during detection. The timer 44 establishes a time, for example, 40 ms, during which a microphone detection process may be executed at the electronic device 10.

The shunt device 46 shunts current for the predetermined duration, for example, 40 ms. after the initial physical connection with the device 10. As previously described, some devices may require support for very low bias voltage microphones that don't draw a high amount of current, while other devices require a high current draw in order to detect a microphone. The microphone compatibility device 16B can accommodate for either device type.

Referring again to Table 1, microphone compatibility device 16B provides a timing scheme, for example, whereby extra power is drawn for a predetermined time, for example, 40 ms, after connection to the device, e.g., Device 1 or Device 2. This amount of time is sufficient to be detected by Device 2. On the other hand, the activation of the microphone 12 for Device 1 is slightly delayed.

In sum, the microphone compatibility device 16B can operate with Device 1 and Device 2 shown in FIGS. 3A and 3B, respectively, and used to draw extra current when Device 1 is connected, so that it detects the microphone 12 coupled to Device 1. With regard to Device 2, extra current is drawn when a lower voltage is applied by Device 2.

The reset device 48 permits the microphone compatibility device 16B to be reset after an unplug or disabling event such as a button press related to the connection between the microphone 12 and the electronic device 10. The reset device 48 resets the timer 44, for example, after the microphone compatibility device 16B is disconnected from the device 10. In embodiments where the timer 44 includes an RC circuit, the reset device 48 may include a diode or related device to quickly drain the capacitor in the timer 44 after physical disconnection, or other event such as pressing a button in lieu of a physical disconnection affecting a transfer of voltage between the microphone 12 and the electronic device 10. The voltage provided may be used to drive the RC timer. In other embodiments, the RC timer begins charging or "counting" immediately upon connection.

Figure 6:
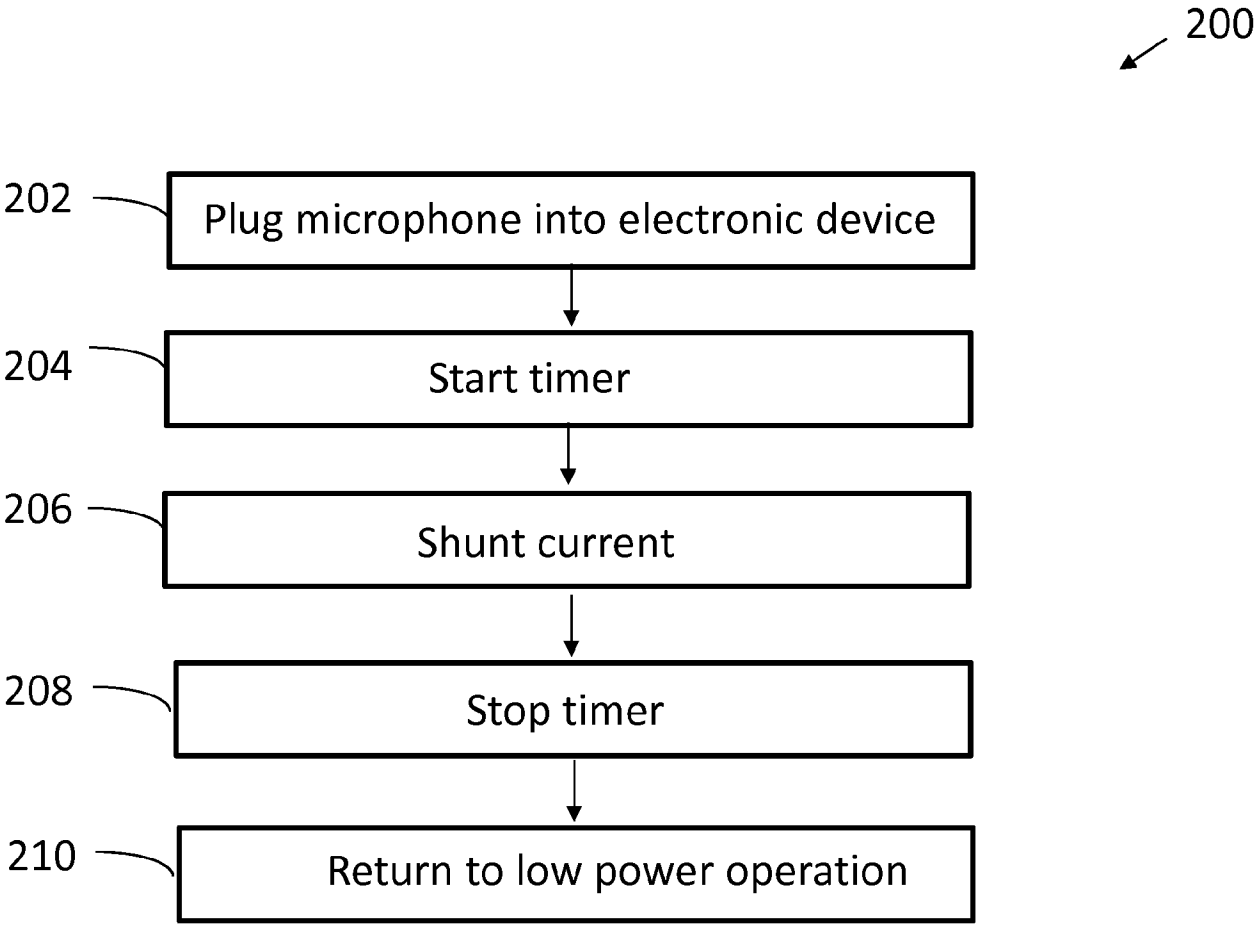
FIG. 6 is a flow diagram of a method for a controlled current draw for microphone compatibility, in accordance with some embodiments.

FIG. 6 is a flow diagram of a method 200 for a controlled current draw for microphone compatibility, in accordance with some embodiments. In describing the method 200, reference is made to elements of FIGS. 1 and 5.

At block 202, the microphone 12 is directly or indirectly coupled to an electronic device 10. The electronic device 10 may include a microphone detection scheme that requires significant current consumption to detect the microphone 12, or require low current consumption to operate properly at all possible microphone bias voltages. When the microphone 12 establishes the electronic device 10 in this manner, an electrical path is formed whereby current flows between the microphone 12 and the electronic device 10. Sensor 42 may detect a voltage on the path.

At block 204, the timer 44 is activated, for example, described above with respect to FIG. 5.

At block 206, current between the microphone 12 and the electronic device 10 is shunted for a predetermined period of time for microphone detection to occur, for example, 40 ms.

At block 208, the timer 44 is stopped.

At block 210, the microphone compatibility device 16B returns to low power operation.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. A microphone compatibility device, comprising:

a sensor that detects a voltage along a conductive path between a microphone and an electronic device of a first or second type; and a regulator that draws current for satisfying a microphone detection current draw requirement of the first type of electronic device, and that prevents a current draw for the second type of electronic device having a lower microphone detection current draw requirement than the microphone detection current draw requirement of the first type of electronic device.

2. The microphone compatibility device of claim 1, wherein the regulator includes a voltage controlled current shunt.

3. The microphone compatibility device of claim 1, wherein the detected voltage is greater than a predetermined voltage, and wherein the current is drawn by the regulator when the detected voltage is greater than the predetermined voltage.

4. The microphone compatibility device of claim 3, wherein the predetermined voltage is greater than a minimum voltage supply of the electronic device.

5. The microphone compatibility device of claim 1, further comprising a current limiter that controls an amount of current through the regulator according to device requirements.

6. The microphone compatibility device of claim 1, wherein the regulator draws the current from time of a connection or enabling event to a time of a physical disconnection or disabling event between the microphone and the second electronic device.

7. A microphone compatibility device, comprising:

a sensor that detects a voltage along a conductive path formed at an initial time between a microphone and an electronic device;

a timer that establishes a period of time after the initial time during which additional current is drawn; and a shunt device that shunts a current so that the additional current is drawn during the period of time after the initial time.

8. The microphone compatibility device of claim 7, wherein the electronic device requires the additional current to be drawn in order to detect the microphone.

9. The microphone compatibility device of claim 7, wherein the electronic device does not require the additional current to be drawn in order to detect the microphone, and wherein the microphone is activated after the period of time.

10. The microphone compatibility device of claim 7, further comprising a reset device that resets the microphone compatibility device after a physical disconnection or disabling event affecting a transfer of voltage between the microphone and the electronic device.

11. The microphone compatibility device of claim 10, wherein the timer includes an RC circuit, and the reset device drains a capacitor of the RC circuit after the physical connection or disabling event.

12. A microphone compatibility device, comprising:

a sensor that detects a voltage along a conductive path between a microphone and at least one electronic device; and a current control device that draws current for permitting microphone detection by each of a first electronic device and a second electronic device, the second electronic device having a lower current draw requirement than the first electronic device, wherein the current control device includes a regulator that draws current for satisfying a microphone detection current draw requirement of the first electronic device, and that prevents a current draw for the second electronic device.

13. The microphone compatibility device of claim 12, wherein the regulator includes a voltage controlled current shunt.

14. The microphone compatibility device of claim 12, wherein the detected voltage is greater than a predetermined voltage, and wherein the current is drawn by the regulator when the detected voltage is greater than the predetermined voltage.

15. The microphone compatibility device of claim 12, further comprising a current limiter that controls an amount of current through the regulator according to device requirements.

16. The microphone compatibility device of claim 12, wherein the regulator draws the current from time of a connection or enabling event to a time of a physical disconnection or disabling event between the microphone and the second electronic device.

17. The microphone compatibility device of claim 12, wherein the current control device includes a timer that establishes a period of time after an initial time during which additional current is drawn and a shunt device that shunts a current so that the additional current is drawn during the period of time after the initial time.

18. The microphone compatibility device of claim 17, wherein the second electronic device does not require the additional current to be drawn in order to detect the microphone, and wherein the microphone is activated after the period of time.

19. The microphone compatibility device of claim 17, further comprising a reset device that resets the microphone compatibility device after a physical disconnection or disabling event affecting a transfer of voltage between the microphone and the first or second electronic device.

20. A microphone compatibility device, comprising:

a sensor that detects a voltage along a conductive path between a microphone and at least one electronic device; and a current control device that draws current for permitting microphone detection by each of a first electronic device and a second electronic device, the second electronic device having a lower current draw requirement than the first electronic device, wherein the current control device includes a timer that establishes a period of time after an initial time during which additional current is drawn and a shunt device that shunts a current so that the additional current is drawn during the period of time after the initial time.

* * * * *